US006736041B2

(12) United States Patent
Portnoy

(10) Patent No.: US 6,736,041 B2
(45) Date of Patent: May 18, 2004

(54) VEGETABLE STICK CUTTING MACHINE

(76) Inventor: Maurice Roger Portnoy, 6106 Lake Lindero Dr., Agoura Hills, CA (US) 91301

( * ) Notice: Subject to any disclaimer, the term of this patent is extended or adjusted under 35 U.S.C. 154(b) by 34 days.

(21) Appl. No.: 09/781,898

(22) Filed: Feb. 9, 2001

(65) Prior Publication Data

US 2002/0108479 A1 Aug. 15, 2002

(51) Int. Cl.[7] ..... B26D 3/18; B26D 7/06

(52) U.S. Cl. ..... 83/404.1; 83/404; 83/425.1; 83/425.3; 83/435; 83/435.2; 83/438; 83/932

(58) Field of Search ..... 83/401, 404, 404.1, 83/407, 408, 409, 409.1, 409.2, 420, 423, 425.3, 435, 435.15, 435.2, 438, 915.3, 932, 425, 425.1, 425.2, 425.4, 437.2, 733; 99/537, 643, 636

(56) References Cited

U.S. PATENT DOCUMENTS

| | | | | | |
|---|---|---|---|---|---|
| 1,281,066 | A | * | 10/1918 | Prior | 83/435.2 X |
| 1,454,555 | A | * | 5/1923 | Nielsen | 83/435.2 X |
| 1,541,603 | A | * | 6/1925 | Turner | 83/425.3 X |
| 2,801,662 | A | | 8/1957 | Brunnier | 99/643 |
| 4,036,123 | A | | 7/1977 | Conkey | 99/538 |
| 4,041,822 | A | * | 8/1977 | Gabel | 83/425.3 X |
| 4,277,999 | A | * | 7/1981 | Conner et al. | 83/425.3 |
| 4,327,616 | A | * | 5/1982 | Klukis | 83/409.2 |
| 4,881,584 | A | * | 11/1989 | Wislocker et al. | 83/423 X |
| 5,168,801 | A | | 12/1992 | Switek, Jr. | 99/546 |
| 5,169,663 | A | | 12/1992 | Rossi et al. | 426/482 |
| 5,410,954 | A | | 5/1995 | Wygal et al. | 99/537 |
| 5,784,937 | A | * | 7/1998 | Wygal et al. | 83/932 X |

* cited by examiner

*Primary Examiner*—Clark F. Dexter
(74) *Attorney, Agent, or Firm*—Goldstein Law Offices, P.C.

(57) ABSTRACT

A cutting machine, for cutting vegetables into vegetable sticks, comprising a horizontal table having a feed end and an exit end. A belt extends vertically atop the table, around rollers which extend perpendicularly from the table. A plurality of cleats extend from the belt which have cleat fingers which extend horizontally outward from the belt. The cleats propel vegetables from the feed end toward the exit end. A horizontal blade assembly is disposed in the path of the cleats, and includes a plurality of horizontal blades which are vertically spaced to extend between the cleat fingers so that the blades do not interfere with the cleat fingers as they propel the vegetables. A vertical blade assembly is located farther toward the exit end than the horizontal blade assembly, and includes a plurality of vertical blades which cut the vegetables into sticks.

6 Claims, 5 Drawing Sheets

VEGETABLE STICK CUTTING MACHINE

BACKGROUND OF THE INVENTION

The invention relates to a vegetable stick cutting machine. More particularly, the invention relates to a machine which creates numerous horizontal cuts and consecutively creates numerous vertical cuts in a vegetable to create vegetable sticks therefrom.

Vegetables, by virtue of coming from nature, are not uniform in size or shape. However, many modern food production, food service, and food handling processes and settings require the use of uniform ingredients. In addition, packaging efficiency for food products is enhanced by making food products more uniform, so that empty space within the packaging is eliminate or reduced.

Accordingly, over the better part of the last century, many have attempted to develop machines for processing food, so as to better adapt ingredients for the demands of our modern, automated society. Generally the systems that are in use attempt to create uniform vegetable sticks by forced extrusion. Such systems jam frequently and have a tendency to create significant spoilage.

U.S. Pat. No. 5,410,954 to Wygal et al. discloses a food slicer which seeks to create vegetable cubes by moving the vegetables through several cutting stations with a pair of conveyer belts. Wygal requires numerous moving parts and considerable space for operation, and thus is unsuitable for most installations.

U.S. Pat. No. 2,801,662 to Brunnier discloses an apparatus for trimming vegetables. U.S. Pat. No. 5,168,801 to Switek, Jr. discloses an apparatus for slicing broccoli into spears.

In general, these machines are frought with problems. They tend to have considerable complexity, and thus have frequent problems, and are expensive to maintain. Often these problems themselves lead to lost production time and wasted food.

Accordingly, while these units may be suitable for the particular purpose employed, or for general use, they would not be as suitable for the purposes of the present invention as disclosed hereafter.

SUMMARY OF THE INVENTION

It is an object of the invention to produce a vegetable cutting machine that is capable of producing vegetable sticks of substantially uniform cross-sectional size. Accordingly, the present invention moves the vegetable axially through both sets of parallel horizontal cutting blades and sets of parallel vertical cutting blades.

It is another object of the invention to provide a vegetable cutting machine that is simple in design so that it is inexpensive to manufacture and easy to maintain. Accordingly, the cutting machine is configured with far less moving parts than other cutting machines in the prior art, so as to minimize manufacturing expense and ensure continued reliability.

It is a further object of the invention to provide a vegetable cutting machine which is compact, so that it requires minimal operating space. Accordingly, the simplistic design allows the cutting machine of the present invention to be made so that it occupies very little space.

It is a still further object of the invention to provide a vegetable cutting machine which is easy to operate, and may be safely operated. Accordingly, the configuration of the cutting blades and proximity of the feed minimizes operator contact with the cutting blades and ensures safe operation. Further, the high reliability of the machine ensures that the operator will have little need to access the mechanical components of the machine.

The invention is a cutting machine, for cutting vegetables into vegetable sticks, comprising a horizontal table having a feed end and an exit end. A belt extends vertically atop the table, around rollers which extend perpendicularly from the table. A plurality of cleats extend from the belt which have cleat fingers which extend horizontally outward from the belt. The cleats propel vegetables from the feed end toward the exit end. A horizontal blade assembly is disposed in the path of the cleats, and includes a plurality of horizontal blades which are vertically spaced to extend between the cleat fingers so that the blades do not interfere with the cleat fingers as they propel the vegetables. A vertical blade assembly is located farther toward the exit end than the vertical blade assembly, and includes a plurality of horizontal blades which cut the vegetables into sticks.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
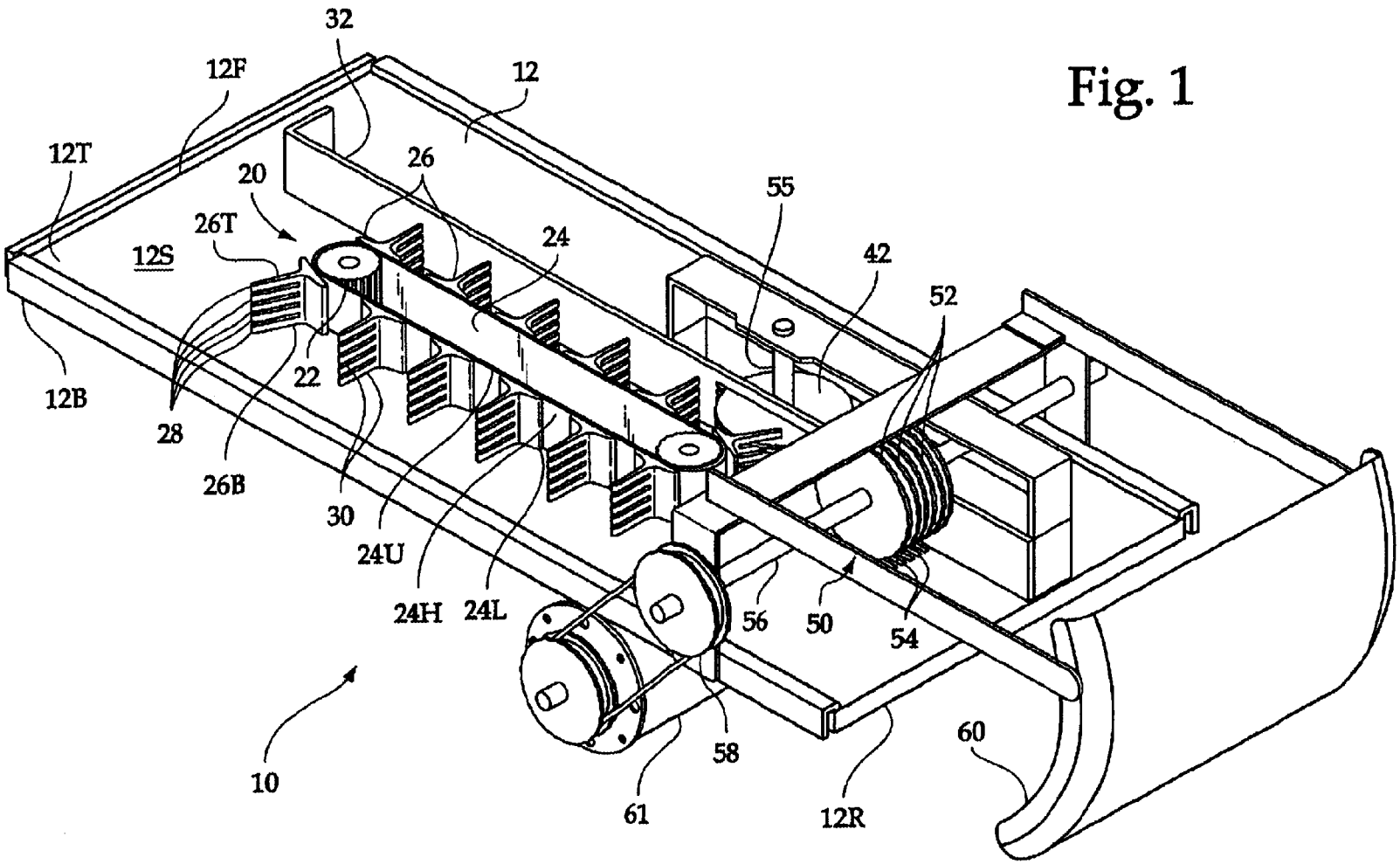
FIG. 1 is a diagrammatic perspective view, illustrating the cutting machine, per se.

FIG. 1 illustrates a vegetable stick cutting machine 10 having a substantially flat, horizontal cutting table 12. The cutting table 12 has a table surface 12S, a top 12T, a bottom 12B, a front 12F and a rear 12R. The front 12F and rear 12R may also be referred to as the feed end and exit end, respectively. It should be noted that designations of "horizontal", "vertical", "front", "rear", and the like are relative terms and may be interchanged consistently while adhering to the concepts of the present invention.

During operation of the cutting machine 10, vegetables such as carrots are fed from the feed end 12F and are carried to the exit end 12R by a belt assembly 20. The belt assembly comprises a pair of rollers 22 which extend vertically perpendicular from the top 12T of the table 12. A belt 24 forms a closed loop around the rollers 22, and extends vertically upward from the table 12 a belt height 24H, which is defined between a belt upper edge 24U and a belt lower edge 24L, best seen in FIG. 3. The belt lower edge 24L extends parallel to the table 12, the lower edge 24L is at all times in close proximity to or touches the table surface 12S.

Figure 3:
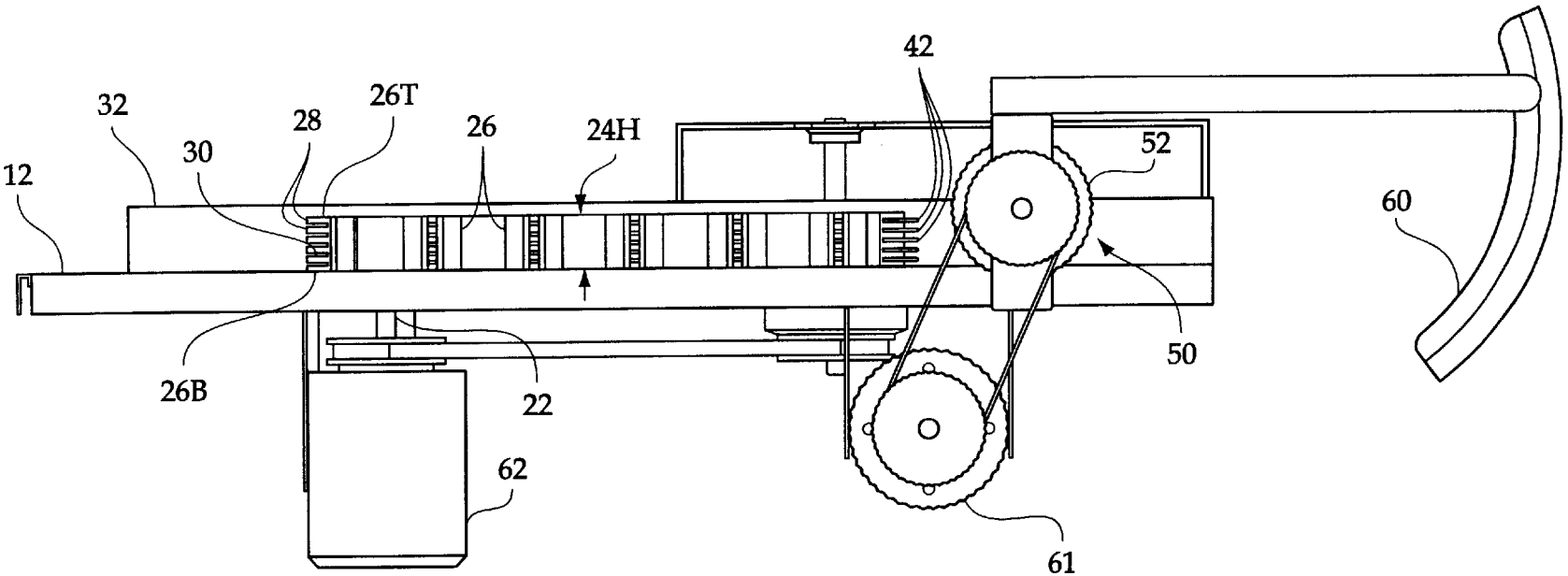
FIG. 3 is a side elevational view, illustrating the cleat fingers extending horizontally from the belt and the concave catcher plate, such that the horizontal blades extend therebetween.

Referring to FIG. 1 and FIG. 3, a plurality of cleats 26 extend horizontally from the belt, substantially extending the entire belt height 24H. The cleats 26 each have a cleat top 26T which is substantially even with belt top 24T, and a cleat bottom 26B, which substantially "sweeps" the table 12. The cleats 26 include a plurality of cleat fingers 28 which extend horizontally away from the belt, and define cleat slots 30 therebetween. The cleat fingers 28 and cleat slots 30 all extend parallel to the table 12.

Figure 2:
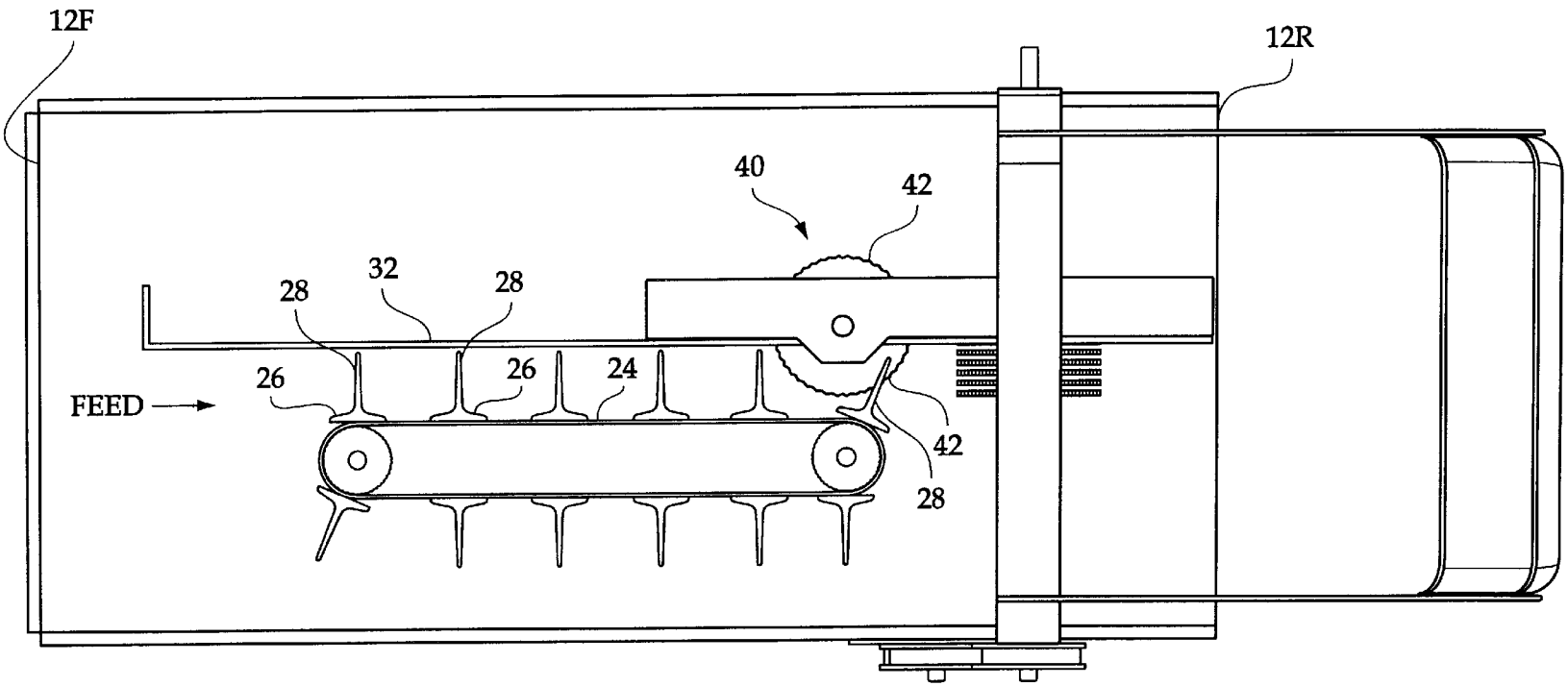
FIG. 2 is a top plan view thereof.

Referring now to FIG. 2, the cleats 26 are each uniformly spaced from each other along the belt 24. The distance between cleats 26 is set so as to accommodate the length of the vegetables to be cut. A vertical guide 32 extends perpendicularly upward from the table 12, extends in the direction from the feed end 12F toward the exit end 12R, and extends parallel to the belt. Accordingly, the cleat fingers 28 extending from the portion of the belt 24 nearest to the vertical guide 32 nearly touch the vertical guide 32 as they travel along said vertical guide 32, as seen in FIG. 2. The cleat fingers 28 thereby push the vegetables from the feed end 12F toward the exit end 12R. In addition, as indicated in FIG. 2 by an arrow accompanied by the indicia "FEED", a feed path is defined as a substantially straight line extending between the feed end 12F and exit end 12R, between the belt 24 and vertical guide 32.

Located between the feed end 12F and exit end 12R is a horizontal cutting blade assembly 40. The horizontal cutting blade assembly 40 includes a plurality of round, substantially flat, parallel horizontal blades 42 which are evenly spaced and extend through slots or openings 34 in the vertical guide 32. The horizontal blades 42 are mounted on a horizontal blade assembly shaft 55. The horizontal blade assembly shaft 55 is located on an opposite side of the vertical guide 32 from the cleats 26 or belt 24. A portion of the horizontal blades 42 extend through the slots 34 in the vertical guide 32, such that the horizontal blades 42 appear to extend in the path of the cleats 26, and do in fact extend in the path of vegetables being pushed by the cleats 26. However, as seen in FIG. 1 and FIG. 2, the cleat fingers 28 and horizontal blades 42 are carefully positioned so that the cleat fingers 28 extend between the horizontal blades 42, and vice versa. Accordingly, the vegetables are effectively pushed through the horizontal blades 42 by the cleat fingers 28, while the blades 42 slide between the cleat fingers 28 without interference therefrom.

Figure 4:
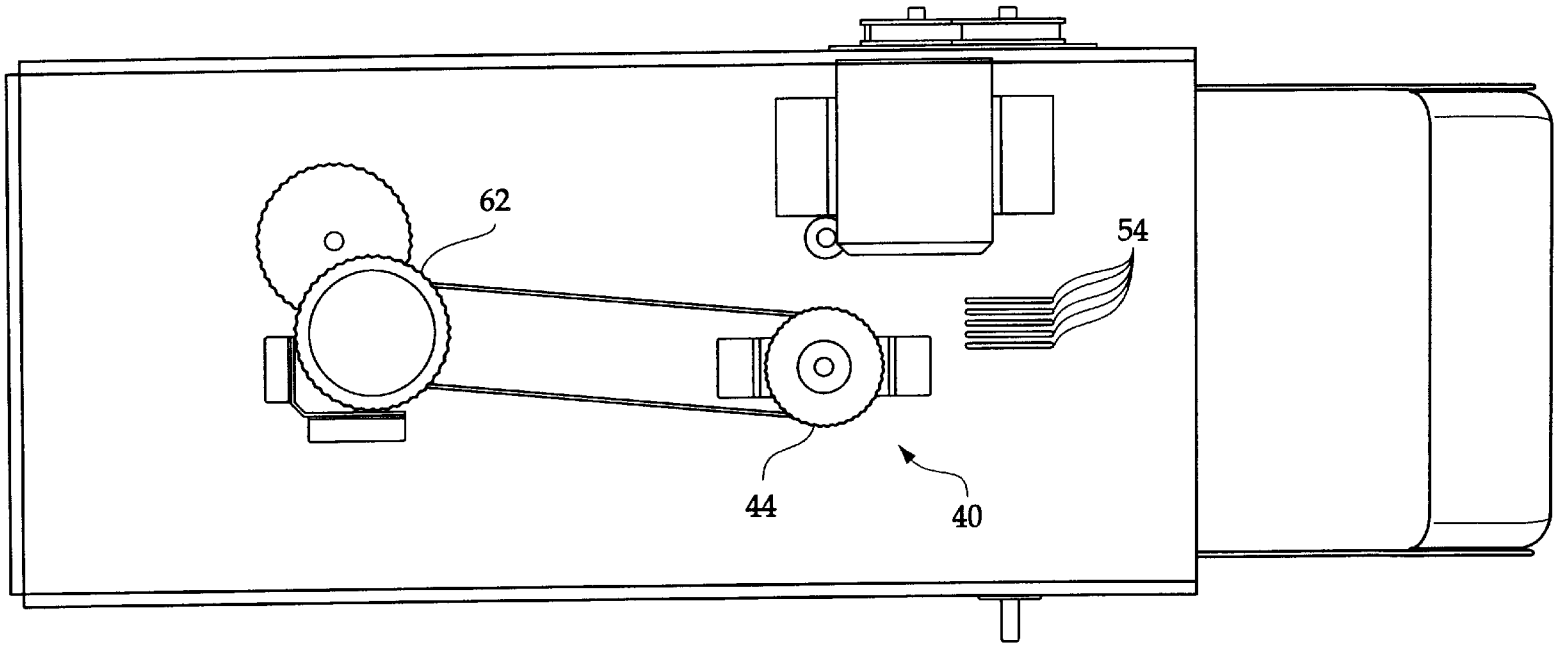
FIG. 4 is a bottom elevational view, illustrating the drive motors, and the vertical blades extending through the cutting table.
Figure 5:
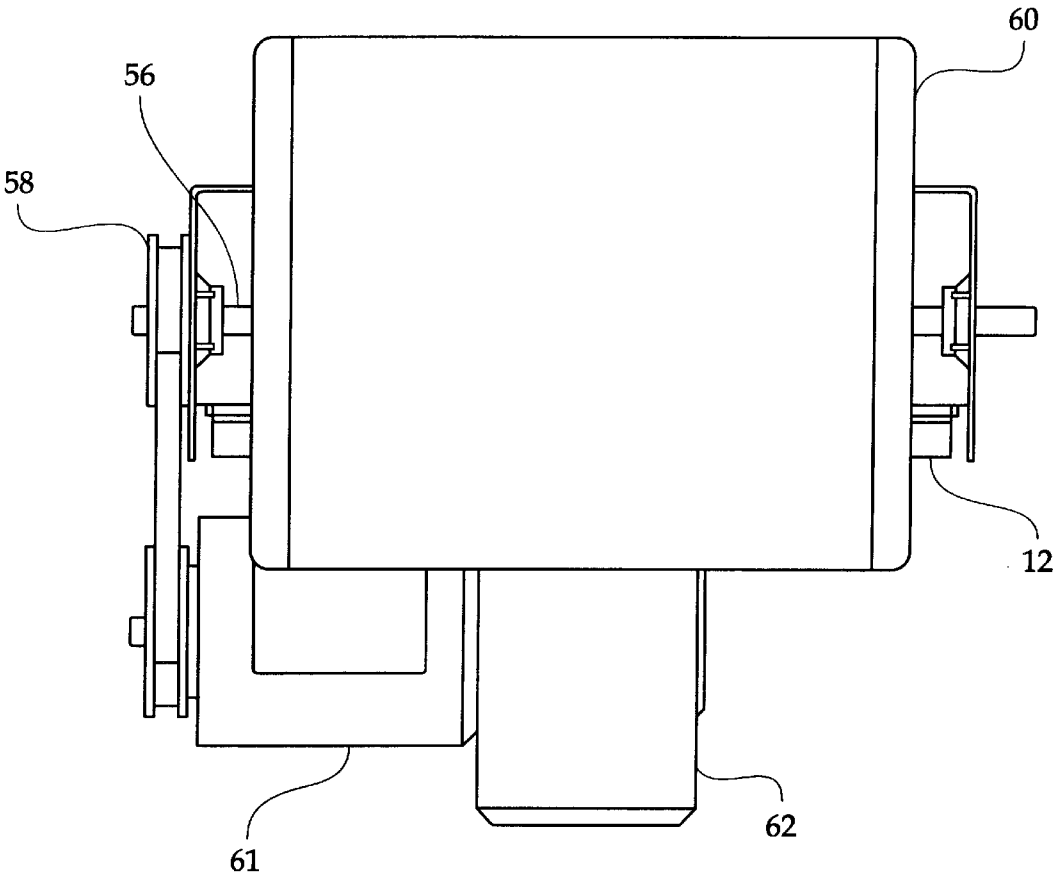
FIG. 5 is a rear elevational view, illustrating interconnection of various drive pulleys, wherein view of the belt and cutting blades is blocked by the catcher plate.

Located further toward the exit end 12R from the horizontal cutting blade assembly 40 is a vertical cutting blade assembly 50. The vertical cutting blade assembly 50 includes a plurality of vertical blades 52. The vertical cutting blades are interposed within the feed path, extending within the direction of travel of the vegetables such that after the vegetables have been sliced by the horizontal cutting blade assembly 40, they encounter the vertical cutting blades 52 where they are sliced into vegetable sticks. The vertical guide 32 extends along the vertical cutting blades 52, in close proximity thereto. As the vegetables are cut by the vertical cutting blades 52 they are expelled from the exit end 12R toward a concave catcher plate 60 which deflects the cut vegetable sticks so that they can fall downward into a container. As seen in FIG. 4, the table has a plurality of vertical cutting blade slots 54 wherein the vertical cutting blades 52 individually extend partially therein so that a "full vertical cut" of the vegetables is obtained.

Hereinabove, components of the cutting machine 10 which interact directly with the vegetables have been described, however further description is provided hereinafter of other components of the cutting machine 10. In particular, the machine is driven by one or more drive motors. In particular, the embodiment shown has a first drive motor 61 and a second drive motor 62. The first drive motor 61 drives the vertical cutting blades 52. The second drive motor 62 drives the horizontal cutting blades 42 and the rollers 22 which move the belt 24. Referring to FIG. 4, the horizontal blade assembly 40 has a horizontal blade pulley 44, which is linked to the second drive motor 62. Referring to FIG. 1, the vertical blade assembly 50 also includes a vertical blade shaft 56, which extends parallel to and across the table 12, and is linked to and extends through the center of each of the vertical blades 52. A vertical blade pulley 58 is mounted to the vertical blade shaft 56, and extends alongside the table 12, so that the first drive motor 61 can be mounted beneath the table 12 and still drive the vertical blades 52.

Additional details of the preferred embodiment of the cutting machine 10 are apparent from the drawing figures. Accordingly, no further discussion thereof is necessary, since such details are well within the grasp of one of ordinary skill in the art.

In conclusion, herein is presented a cutting machine which makes consecutive horizontal and vertical cuts in vegetables, so as to create vegetable sticks in an efficient and reliable manner. In the foregoing description, and throughout the drawing figures, the invention is presented by example. However it should be understood that numerous variations are possible while adhering to the inventive concepts. Such variations are contemplated as being a part of the present invention.

What is claimed is:

1. A cutting machine, for cutting vegetables into vegetable sticks, comprising:

a cutting table, the table substantially flat and horizontal, having a substantially horizontal table surface, a feed end and an exit end;

a belt assembly, including rollers which axially extend vertically from the table surface, and a belt extending substantially horizontally around the rollers in a closed loop, the belt further extending vertically having a lower edge, which extends substantially parallel to the table surface and substantially touches the table surface, and an upper edge, wherein a belt height is defined between the lower edge and upper edge;

a plurality of cleats attached to the belt, each of the cleats having a plurality of cleat fingers extending radially outward from the belt, each cleat having a height that is substantially equal to the belt height and extending substantially between the table surface and the upper edge of the belt, the cleat fingers capable of propelling vegetables inserted at the feed end toward the exit end; and a horizontal blade assembly, including a plurality of horizontal blades positioned in the path of vegetables pushed by the cleats, the horizontal blades extending parallel to the table surface, and vertically spaced apart consistent with the cleat fingers so that as the belt moves the cleat fingers extend between the horizontal blades and the horizontal blades extend between the cleat fingers so that the cleat fingers push the vegetables through the horizontal blades but the cleat fingers do not interfere with the blades.

2. The cutting machine as recited in claim 1, further comprising a vertical blade assembly, the vertical blade assembly located further toward the exit end than the horizontal blade assembly, the vertical blade assembly comprising a plurality of vertical blades which are spaced apart and extend vertically with respect to the table.

3. The cutting machine as recited in claim 2, further comprising a vertical guide, the vertical guide extending perpendicular to the table surface substantially between the feed end and exit end, the vertical guide helping direct the vegetables toward the vertical blade assembly and horizontal blade assembly, the vertical guide thereby defining a feed path which is a substantially straight line extending between the feed end and exit end, between the vertical guide and the belt, wherein the horizontal blade assembly and vertical blade assembly are both disposed along the feed path.

4. The cutting machine as recited in claim 3, wherein the horizontal blades and vertical blades are round and substantially flat.

5. The cutting machine as recited in claim 4, wherein the table has a plurality of vertical blade cutting slots, each vertical blade cutting slot positioned directly below one of the vertical blades so that each of the vertical blades extends partially into one of the vertical blade cutting slots.

6. The cutting machine as recited in claim 5, wherein the vertical guide has a plurality slots, such that the horizontal blades extend through the slots in the vertical guide, and wherein the horizontal blade assembly further comprises a horizontal blade assembly shaft which extends through the center of each of the horizontal blades, and wherein the horizontal blade assembly shaft is located on an opposite side of the vertical guide from the cleats.

* * * * *